US008251104B2

(12) United States Patent
Itagaki et al.

(10) Patent No.: US 8,251,104 B2
(45) Date of Patent: Aug. 28, 2012

(54) REINFORCING BAR BINDER

(75) Inventors: Osamu Itagaki, Tokyo (JP); Ichiro Kusakari, Tokyo (JP); Takahiro Nagaoka, Tokyo (JP)

(73) Assignee: Max Co., Ltd., Tokyo (JP)

( * ) Notice: Subject to any disclaimer, the term of this patent is extended or adjusted under 35 U.S.C. 154(b) by 483 days.

(21) Appl. No.: 12/465,929

(22) Filed: May 14, 2009

(65) Prior Publication Data

US 2009/0283169 A1 Nov. 19, 2009

(30) Foreign Application Priority Data

May 19, 2008 (JP) ..... 2008-130645

(51) Int. Cl.
*B21F 7/00* (2006.01)
*B21F 15/04* (2006.01)

(52) U.S. Cl. ..... 140/119; 140/93.2

(58) Field of Classification Search ..... 140/117–119, 140/93.2, 93 R; 53/139.4, 137.2, 139.1, 53/414; 100/28, 32, 25–26; 242/597, 597.1, 242/597.2, 597.3, 597.4
See application file for complete search history.

(56) References Cited

U.S. PATENT DOCUMENTS

| | | | | |
|---|---|---|---|---|
| 5,515,887 | A * | 5/1996 | Hanagasaki et al. | 140/119 |
| 6,000,443 | A * | 12/1999 | Hayashi et al. | 140/119 |
| 7,819,143 | B2 * | 10/2010 | Nagaoka et al. | 140/119 |

FOREIGN PATENT DOCUMENTS

| | | | |
|---|---|---|---|
| DE | 43 00 247 | A1 | 11/1993 |
| DE | 44 13 627 | A1 | 10/1994 |
| EP | 1 612 348 | A1 | 1/2006 |
| EP | 1 757 755 | A1 | 2/2007 |
| EP | 1 777 360 | A1 | 4/2007 |
| JP | 2558393 | | 9/1997 |
| JP | 11-156744 | | 6/1999 |
| JP | 2003-175904 | | 6/2003 |
| JP | 2005-194847 | | 7/2005 |

* cited by examiner

*Primary Examiner* — Edward Tolan
*Assistant Examiner* — Mohammad I Yusuf
(74) *Attorney, Agent, or Firm* — Drinker Biddle & Reath LLP

(57) ABSTRACT

In a reinforcing bar binder in which a wire reel around which a reinforcing bar binding wire is wound is rotatably housed in a housing chamber in a binder main body, the wire is pulled out from the wire reel and wound around reinforcing bars, and the reinforcing bars are bound by twisting the wound portion, an opening is formed through one of both side walls of the housing chamber at a position corresponding to a shaft receiving portion formed on the wire reel. On the one side wall, a reel receiver which is supported so as to come into and come out from the opening is fitted to the shaft receiving portion of the wire reel when it is pushed into the inside of the side wall. A reel stopper moves along the wall surface of the one side wall and can engage with the reel receiver fitted to the shaft receiving portion. A leaf spring urges the reel stopper engaged with the reel receiver to the pushing-in side.

3 Claims, 9 Drawing Sheets

REINFORCING BAR BINDER

BACKGROUND OF THE INVENTION

1. Field of the Invention

The present invention relates to a reinforcing bar binder.

2. Background Art

In the reinforcing bar binder, a wire reel around which a wire for binding reinforcing bars is wound is rotatably housed in a housing chamber provided in a binder main body, and a leading end of the wire is pulled out from the wire reel and fed out to the circumference of the reinforcing bars and wound around the reinforcing bars, and then twisted to bind the reinforcing bars.

In this type of reinforcing bar binder, the wire reel is disposed between a side wall disposed inside the binder main body in the housing chamber and a sidewall disposed outside. The wire reel has a central hole provided at a portion of the rotation center. At the central portion of this central hole, a winding end portion of the wire is rolled in so as to prevent the wire from coming out from the wire reel. Therefore, a rotation shaft cannot be inserted through the central hole.

Therefore, on one side of the wire reel, a circular concave portion is formed around the central hole. In this concave portion, a reel guide projecting in a disk shape provided on the side wall of the binder main body is fitted to rotatably support the wire reel. On the other side of the wire reel, a reel receiver is fitted to an opening end side of the central hole from the other side wall to rotatably support the wire reel. Thus, the reel guide and the reel receiver sandwich and support the wire reel. The reel receiver is provided at an end portion of a support arm axially supported so as to approach and separate from the side wall of the housing chamber. By pushing the reel receiver into an inside of the housing chamber from the opening formed through the side wall by operating the support arm, the reel receiver is shallowly fitted in the central hole of the wire reel.

The above structure is disclosed, for example, in JP-Y-2558393 and JP-A-2005-194847.

However, in the above structure, on the side wall, a reel stopper is provided together with the reel receiver. The reel stopper engages with the reel receiver fitted in the central hole and prevents the reel receiver from separating. Thus, the reel receiver is provided on the support arm which turns, so that after assembling, the reel receiver rattles. Further, the reel stopper is engaged so as to merely prevent the reel receiver from coming out. Therefore, rattling of the reel receiver may be occurred to make a rotation of the wire reel unstable.

SUMMARY OF THE INVENTION

One or more embodiments of the invention provide a reinforcing bar binder in which a wire reel can always be stably rotated.

In accordance with one or more embodiments of the invention, a reinforcing bar binder 1 is provided with: a housing chamber 3 to which a wire reel 4 is rotatably housed; an opening 24 formed through one 14 of both side walls 13, 14 of the housing chamber 3 at a position corresponding to a shaft receiving portion 20, 21 of the wire reel 4; a reel receiver 27 which is provided on said one 14 of the side walls 13, 14 so as to come out from and come into the opening 24 and fits to the shaft receiving portion 21 of the wire reel 4 when the reel receiver 27 is pushed into an inside of said one 14 of the side walls 13, 14; a reel stopper 33 which is movable along a wall surface of said one 14 of the side walls 13, 14 to engage with the reel receiver 27 fitting to the shaft receiving portion 21; and an elastic body 44 which urges the reel stopper 33 engaged with the reel receiver 27 in a direction so that the reel stopper 33 is pushed-in toward the wire reel 4.

In the above configuration, after the wire reel is housed in the housing chamber, the reel receiver is pushed into the opening and fitted to the shaft receiving portion of the wire reel, and further, the reel stopper is turned and engaged with the reel receiver, and accordingly, the wire reel is rotatably supported, and the reel stopper is also held so as to prevent the reel receiver from coming out from the opening. Then, the reel stopper engaged with the reel receiver is urged to the pushing-in side by the elastic body. Therefore, the reel stopper becomes stable, and the wire reel can always be rotated stably.

The reinforcing bar binder 1 may include: a concave portion 36 provided on one of the elastic body 44 and the reel stopper 33; and a convex portion 46 provided on the other of elastic body 44 and the reel stopper 33 and capable of resiliently engaging with the concave portion 36.

According to the above configuration, the concave portion and the convex portion which can resiliently engage with each other are formed on the elastic body and the reel stopper, so that a clicking feeling can be obtained when they are engaged.

The reinforcing bar binder 1 may further include a metallic cover 37 provided on an engaging portion between the reel receiver 27 and the reel stopper 33.

According to the above configuration, on the engaging portion between the elastic body and the reel stopper, the metallic cover is provided, so that even when they are repeatedly engaged and disengaged, the engaging portion is hardly worn.

In addition, the reel stopper 33 may include a lever part 34 and a stopper part 35. The stopper part 35 may move to engage with and disengage from the reel receiver 27 by operating the lever part 34. The elastic body 44 may push the lever part 34 so that the stopper part 35 engaged with the reel receiver 27 pushes the reel receiver 27 toward the wire reel 4.

Other aspects and advantages of the invention will be apparent from the following description, the drawings and the claims.

DESCRIPTION OF THE REFERENCE NUMERALS

3 Housing chamber
4 Wire reel
5 Wire
24 Opening
27 Reel receiver
33 Reel stopper
44 Leaf spring

DETAILED DESCRIPTION OF THE EXEMPLARY EMBODIMENTS

An exemplary embodiment of the invention is described with reference to drawings.

Figure 1:
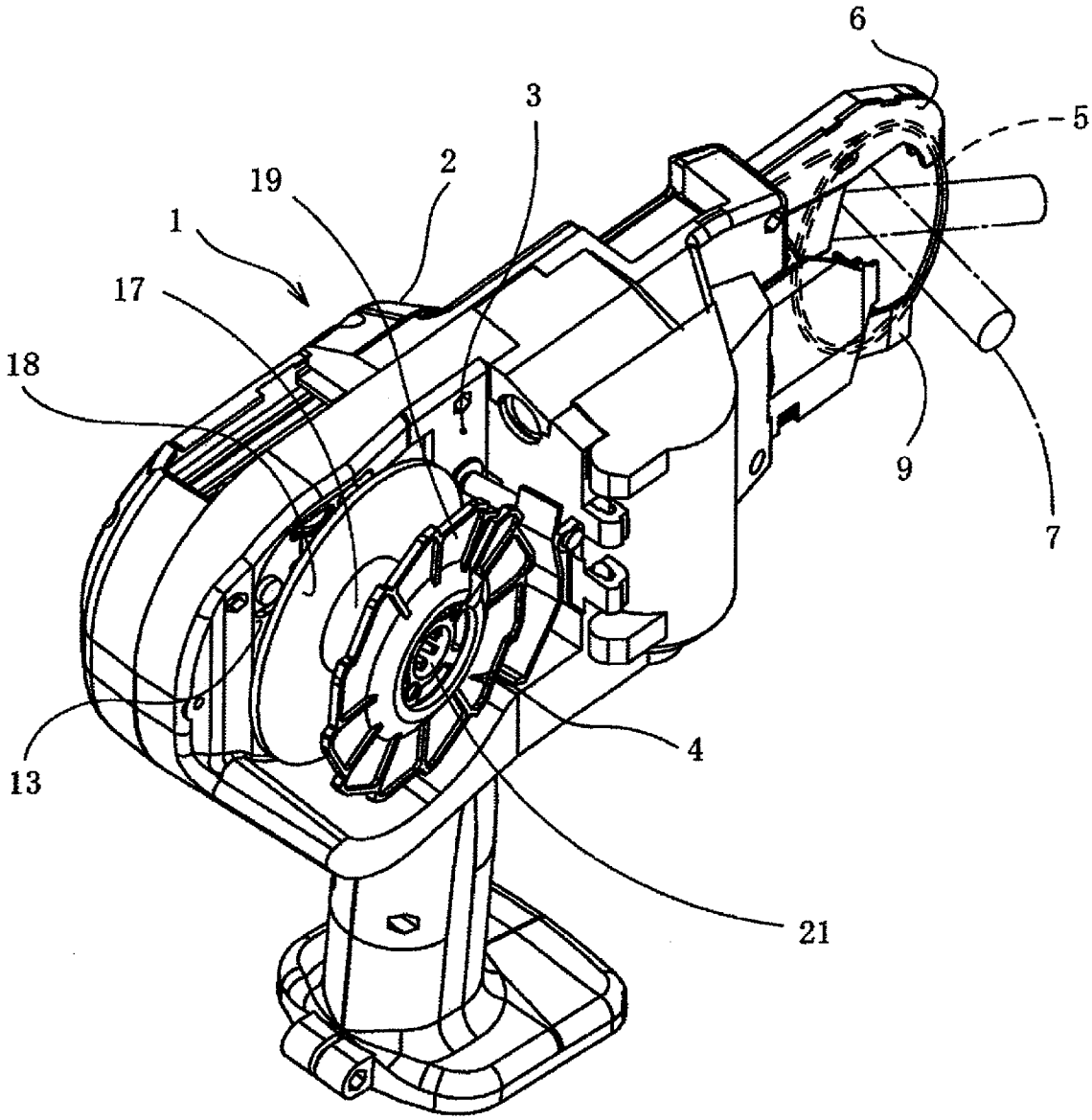
FIG. 1 is a perspective view of an essential portion in a state where a cover on one side is removed in a reinforcing bar binder of an exemplary embodiment of the invention.

In FIG. 1, the reference numeral 1 denotes a reinforcing bar binder. In the reinforcing bar binder 1, a wire reel 4 around which a reinforcing bar binding wire 5 is wound is fitted in a housing chamber 3 provided in a binder main body 2. A predetermined length of the wire 5 is fed to a guide part 6 provided on the tip end of the binder main body 2 while the wire reel 4 is rotated. The wire 5 is curled by the guide part 6 and fed out around reinforcing bars 7 positioned inside the guide part 6 so that the wire 5 is wound around the reinforcing bars. Then, a root side of the wire 5 is cut and the wound portion is twisted to bind the reinforcing bars 7.

Between the housing chamber 3 and the guide part 6, a guide tube (not shown) in which the wire 5 is inserted is provided. At the middle of the guide tube, wire feed gears 10 to be driven by an electric motor 8 are disposed. At the guide part 6, a wire cutting device and a wire twisting device are disposed although these are not shown. When a switch is turned ON by a trigger 11, the electric motor 8 rotates and the wire feed gears 10 rotate, so that the wire 5 wound around the wire reel 4 housed in the housing chamber 3 is fed forward of the binder main body 2 through the guide tube.

The guide part 6 curls the wire 5 so that the wire 5 fed into the binder main body 2 is delivered while being curled, and the wire is curled and circled around the reinforcing bars 7 between the guide part and a lower guide 9. Then, after the wire 5 is wound around the reinforcing bars 7, it is cut by the cutting device driven by another electric motor and twisted by the twisting device to bind the reinforcing bars.

Actuations, etc., of the wire feed gears, the wire cutting device, and the wire twisting device are sequence-controlled by a control circuit not shown. The control circuit also measures the feeding amount of the wire 5.

Figure 2:
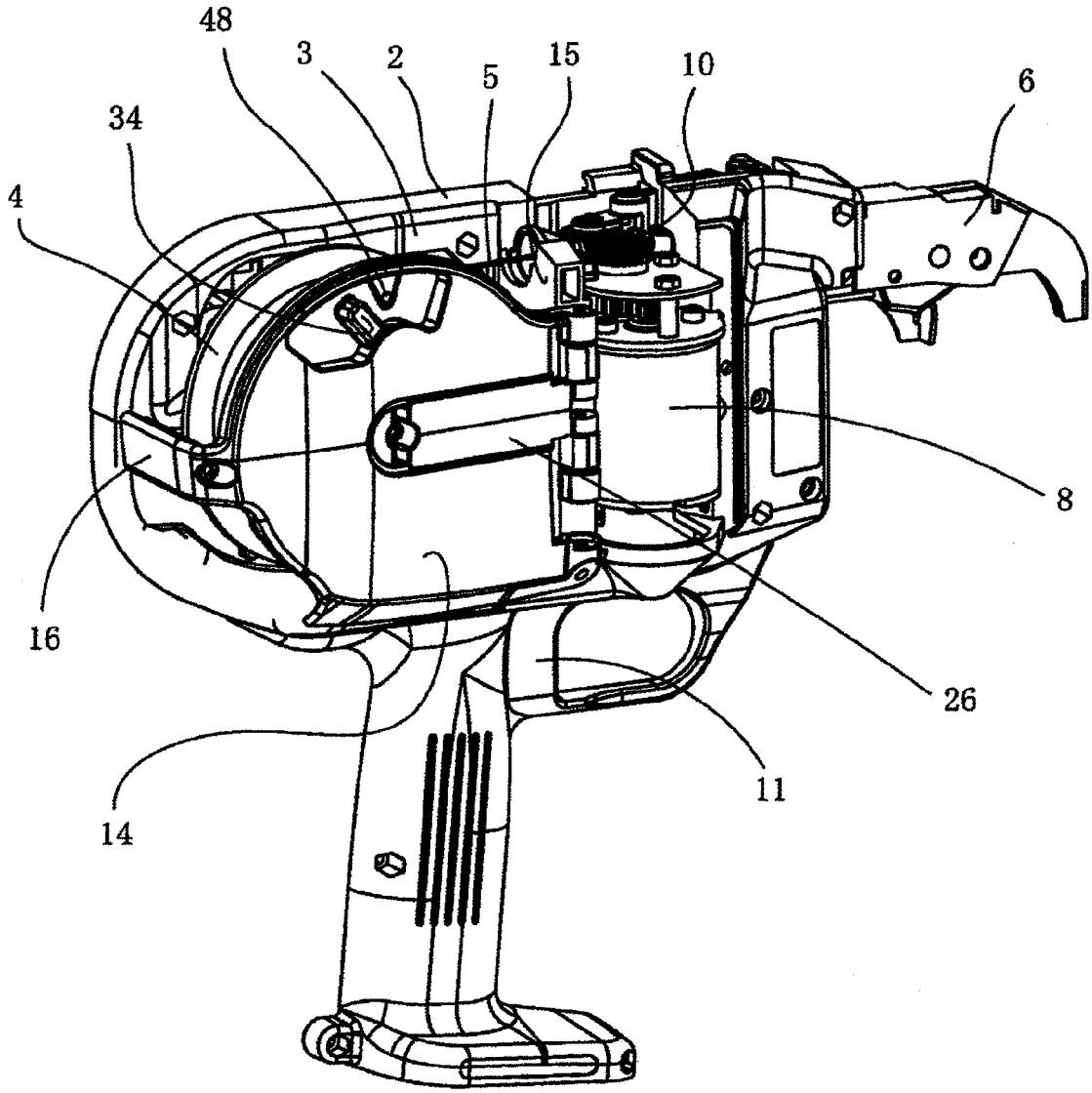
FIG. 2 is a perspective view of an essential portion of the reinforcing bar binder.
Figure 3:
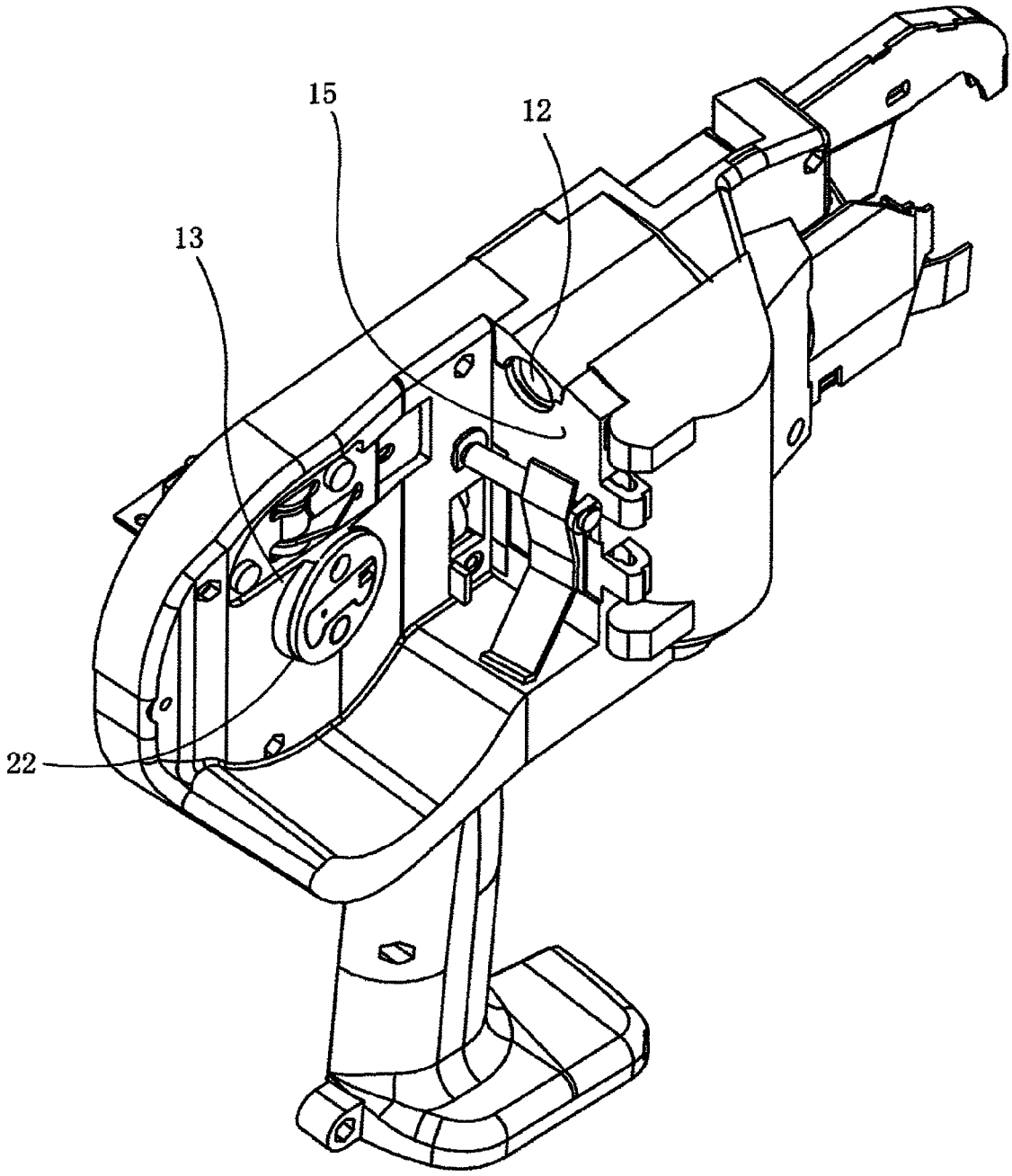
FIG. 3 is a perspective view of an essential portion in a state where the wire reel and the cover of the reinforcing bar binder are removed.

The housing chamber 3 of the wire reel 4 includes, as shown in FIG. 2 and FIG. 3, an inner side wall 13 on the binder main body 2 side, an outer side wall 14 on the opposite side of the inner side wall, and a front wall 15 in which the end portion 12 of the guide tube is opened. The outer side wall 14 is formed of one wall member, and the front end and the rear end thereof are fixed by the front wall 15 and a fixing member 16 projecting from the inner side wall 13.

Figure 4A:
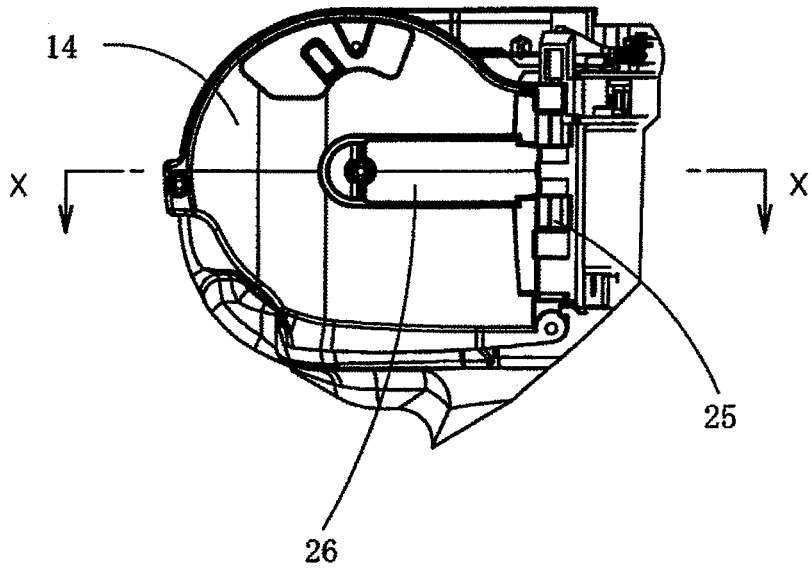
FIG. 4(*a*) is a side view of a wire reel portion of the reinforcing bar binder, and FIG. 4(*b*) is a sectional view along X-X line of FIG. 4(*a*)
Figure 4B:
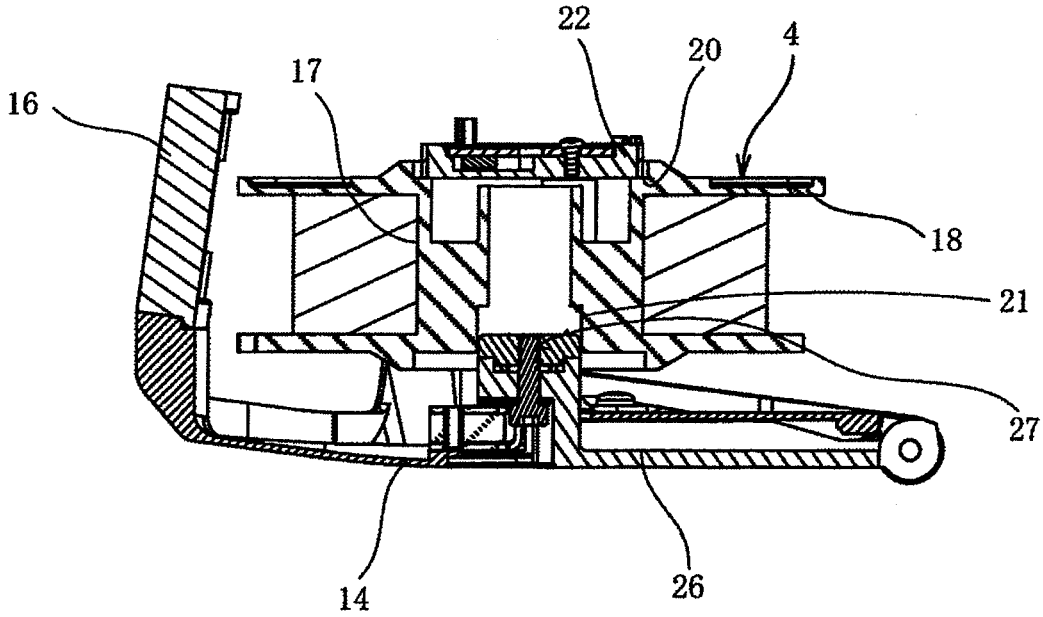

The wire reel 4 is made of, as shown in FIG. 1, plastic such as ABS resin, polyethylene, polypropylene, etc., having excellent resistance against wearing and bending, and is made of black plastic so as to prevent entrance of ambient light. The wire reel 4 includes a hub 17 around which the wire is wound and disk-shaped flanges 18 and 19 provided on both sides of the hub 17. The hub 17 is formed into a cylindrical shape, and is molded integrally with the pair of flanges 18 and 19. As shown in FIG. 4(*b*), at the central portion of the hub 17, a central hole (shaft receiving portion) 21 is formed. A reel receiver 27 described later provided on the outer side wall 14 of the reinforcing bar binder 1 is fitted into the central hole 21.

At the center of the outer side surface of one flange 18, an annular concave portion 20 is formed. At the central portion of the other flange 19, a central hole 21 is opened. The annular concave portion 20 and the central hole 21 form the shaft receiving portion of the wire reel 4, and are supported rotatably by a shaft-like reel receiving means provided on the inner side wall 13 and the outer side wall 14 of the binder main body.

The reel receiving means on the inner side wall 13 and the outer side wall 14 will be described next.

Figure 5:
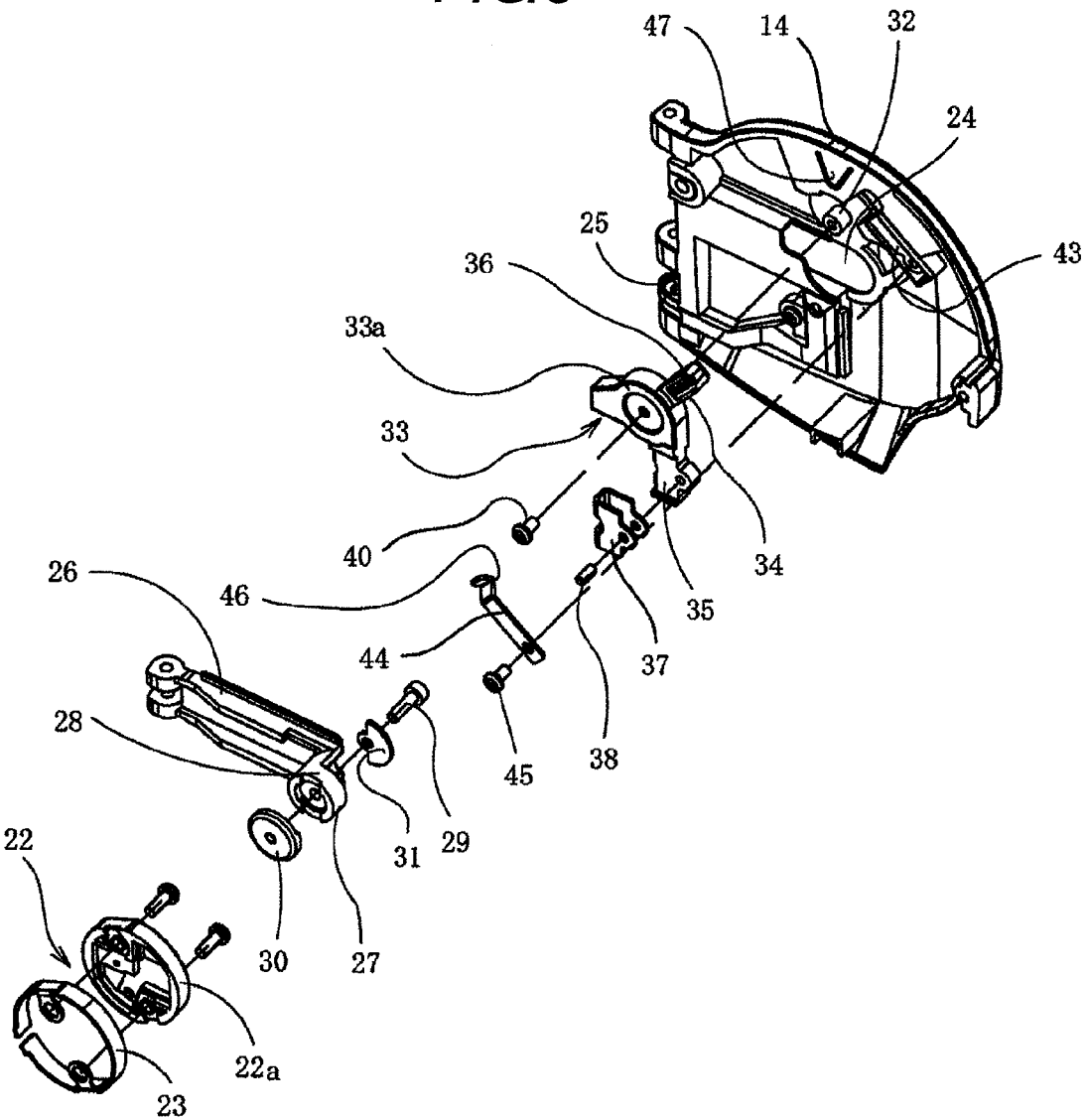
FIG. 5 is an exploded perspective view of components attached to inner and outer side walls.

A reel guide 22 is formed so as to project from the inner side wall 13 of the wire reel housing chamber 3 as shown in FIG. 3. The reel guide 22 includes, as shown in FIG. 5, a disk-shaped guide main body 22*a* and a guide ring 23 made of a metal such as iron wound around the guide main body 22*a*.

Next, at the central portion of the outer side wall 14, an opening 24 is formed so as to penetrate to the inside and the outside. On a support shaft 25 provided on the front end portion of the outer side wall 14, one end of a support arm 26 is axially supported so as to turn to approach and separate from the outer side wall 14 as shown in FIG. 2 and FIG. 5. On the other end of the support arm 26, a reel receiver 27 is formed. The reel receiver 27 is provided at a position deflected to the inner side more than the extension of the support arm 26 via an arc-shaped joint piece 28 bent to the inner side from the end portion of the support arm 26. Thus, the support arm 26, the joint piece 28 and the reel receiver 27 are formed so as to form substantially a Z shape. The support arm 26 and the reel receiver 27 are made of a synthetic resin. The inner and outer surfaces of the reel receiver 27 are covered by a metallic reel receiver head 30 and a metallic semicircular engaging plate 31. The reel receiver head 30 and the engaging plate 31 are fixed to the reel receiver 27 by a screw 29. As shown in FIG. 4(*b*) and FIG. 6, the reel receiver 27 is formed to a size which can be fitted in the central hole 21 of the wire reel 4.

Figure 6:
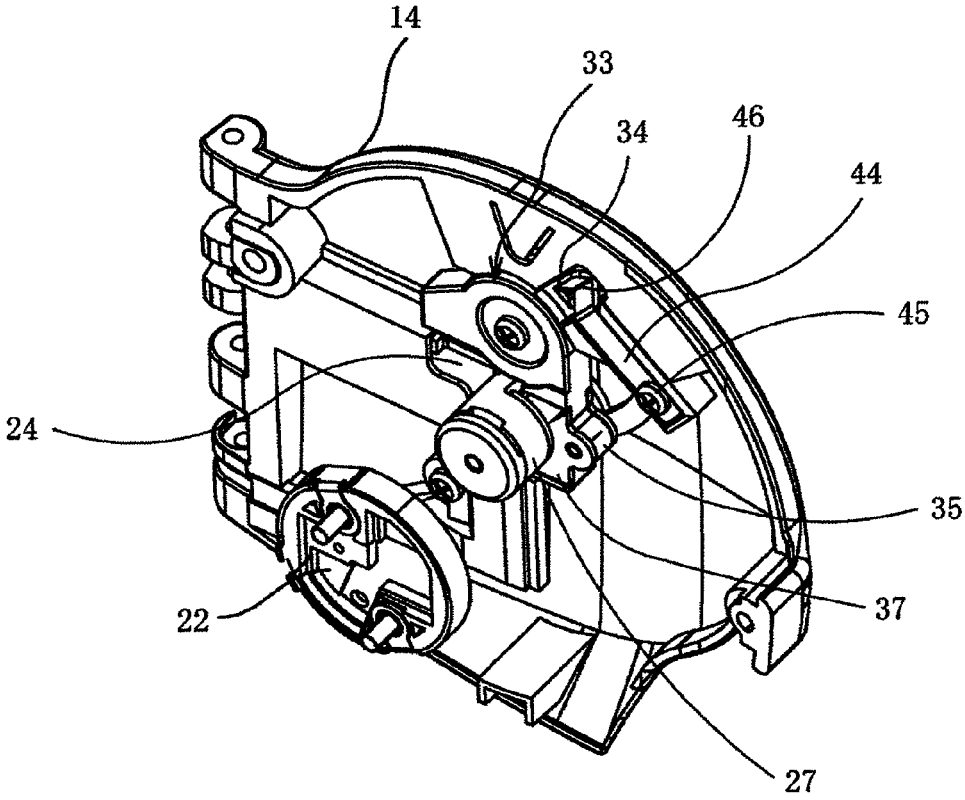
FIG. 6 is a perspective view showing a support portion of the wire reel.

As shown in FIG. 6, in the binder main body 2, the reel guide 22 and the reel receiver 27 are coaxially disposed. Then, the reel guide 22 is fitted to the annular concave portion 20 on one side of the wire reel 4, and the reel receiver 27 is fitted to the central hole 21 of the wire reel 4. Accordingly, the wire reel 4 can be rotatably supported.

Figure 7:
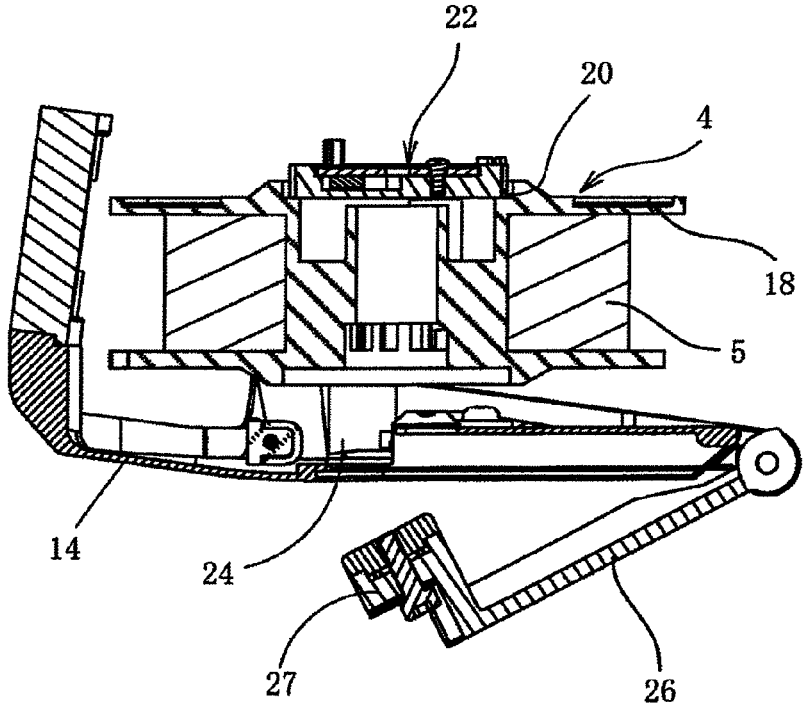
FIG. 7 is a sectional view showing a state where the support arm opens in the same section as that of FIG. 4(*b*)
Figure 8:
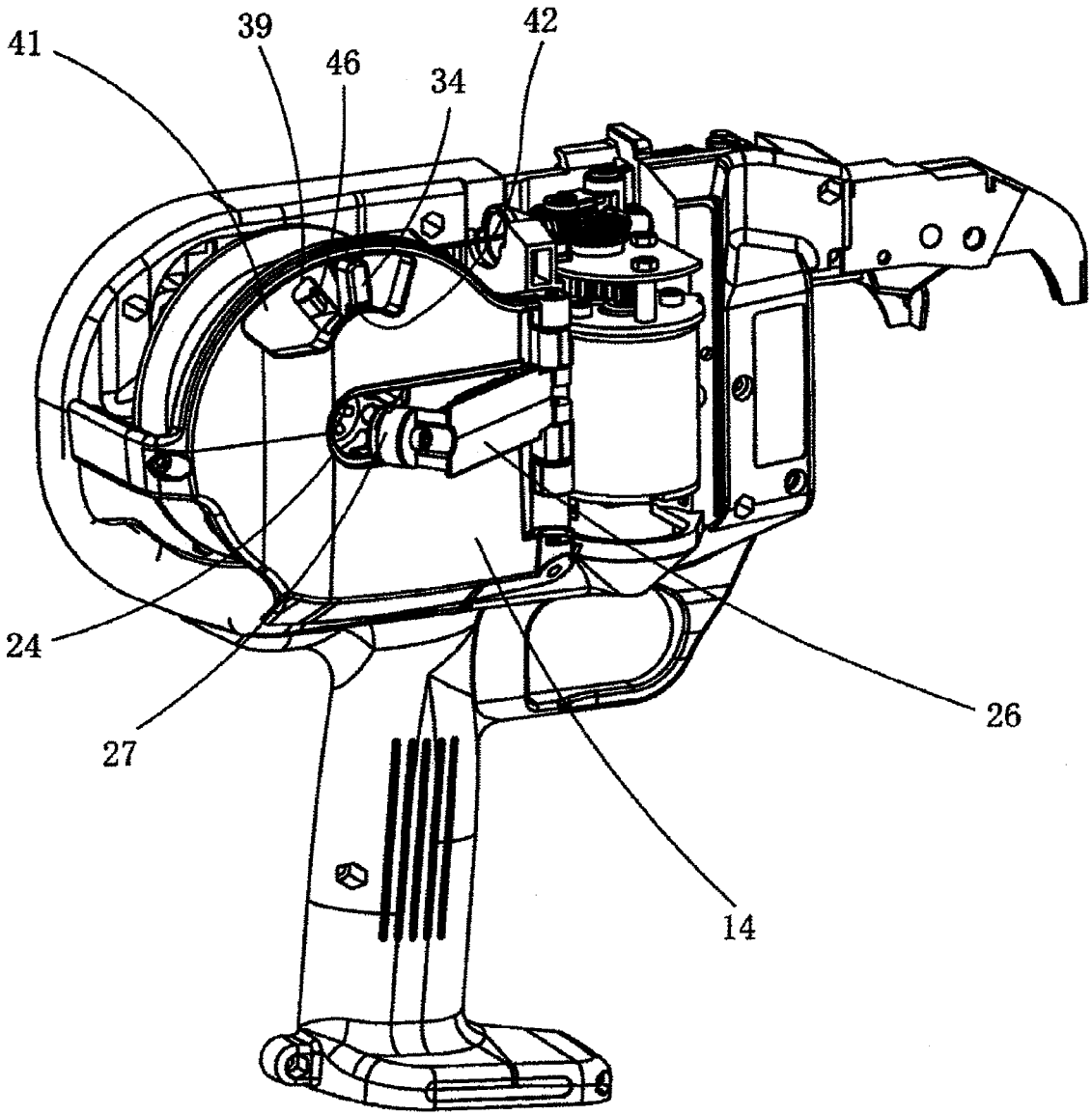
FIG. 8 is a perspective view of an essential portion showing the state where the support arm opens.

To attach or detach the wire reel 4, the reel receiver 27 must be fitted to or removed from the wire reel 4. Therefore, the support arm 26 moves in a thickness direction of the outer side wall 14 so as to approach and separate from the outer side wall 14 as shown in FIG. 7 and FIG. 8. The support arm 26 is normally urged to separate from the outer side wall 14 by a spring not shown. When the wire reel 4 is attached, the support arm 26 is turned to approach the outer side wall 14 so that the reel receiver 27 projects to the inner side of the outer side wall 14.

Next, on the outer side wall 14, a lock mechanism of the reel receiver 27 is provided so as to hold the state where the reel receiver 27 rotatably supports the wire reel 4. As shown in FIG. 5 and FIG. 6, on the upper portion of the opening 24, a shaft part 32 is integrally formed. On this shaft part 32, a reel stopper 33 made of a synthetic resin is provided so as to turn along the wall surface of the outer side wall 14. The reel stopper 33 includes a central main body 33*a*, a lever part 34 projecting diagonally upward of the main body 33*a*, and a stopper part 35 projecting downward from one side of the main body 33*a*. Inside the lever part 34, a V-groove-shaped concave portion 36 is formed. The stopper part 35 is covered by a C-shaped cover 37 made of metal, and the C-shaped cover 37 is fixed to the stopper part 35 by a spring pin 38. The main body 33*a* is attached to the shaft part of the outer side wall 14 by a screw 40 so as to turn. The main body 33*a* and the stopper part 35 of the reel stopper 33 are disposed inside the outer side wall 14.

Further, the lever part 34 is formed so as to be exposed to the outside of the outer side wall 14. In other words, as shown in FIG. 8, on the outer side surface of the outer side wall 14, in a range in which the lever 34 turns along with the turn of the reel stopper 33, a fan-shaped concave portion 41 is formed, and at the bottom portion thereof, an opening 42 which the lever part 34 is inserted through is formed. The lever part 34 is exposed to the outside from this opening 42. Accordingly, an operator can rotate the reel stopper 33 by taking the lever part 34 by hand and operates the stopper part 35 in a direction of engagement with or disengagement from the reel receiver 27.

Inside the outer side wall 14, as shown in FIG. 5 and FIG. 6, near the reel stopper 33, a housing concave portion 43 is formed. In the housing concave portion, a leaf spring (or other elastic body) 44 is housed and fixed by a screw 45. On a tip end of the leaf spring 44, a V-shaped convex portion 46 projecting outward is formed. This convex portion 46 is exposed to the outside through the opening 39 (see FIG. 9) formed in the outer side wall 14. When the reel stopper 33 turns, one turning end of the reel stopper is resiliently engaged with a concave portion 36 of the lever part 34. At this time, the leaf spring 44 is not only engaged with but also urges the stopper part 35 of the reel stopper 33 to the pushing-in side, that is, urges the stopper part to the wire reel 4 side.

Figure 9:
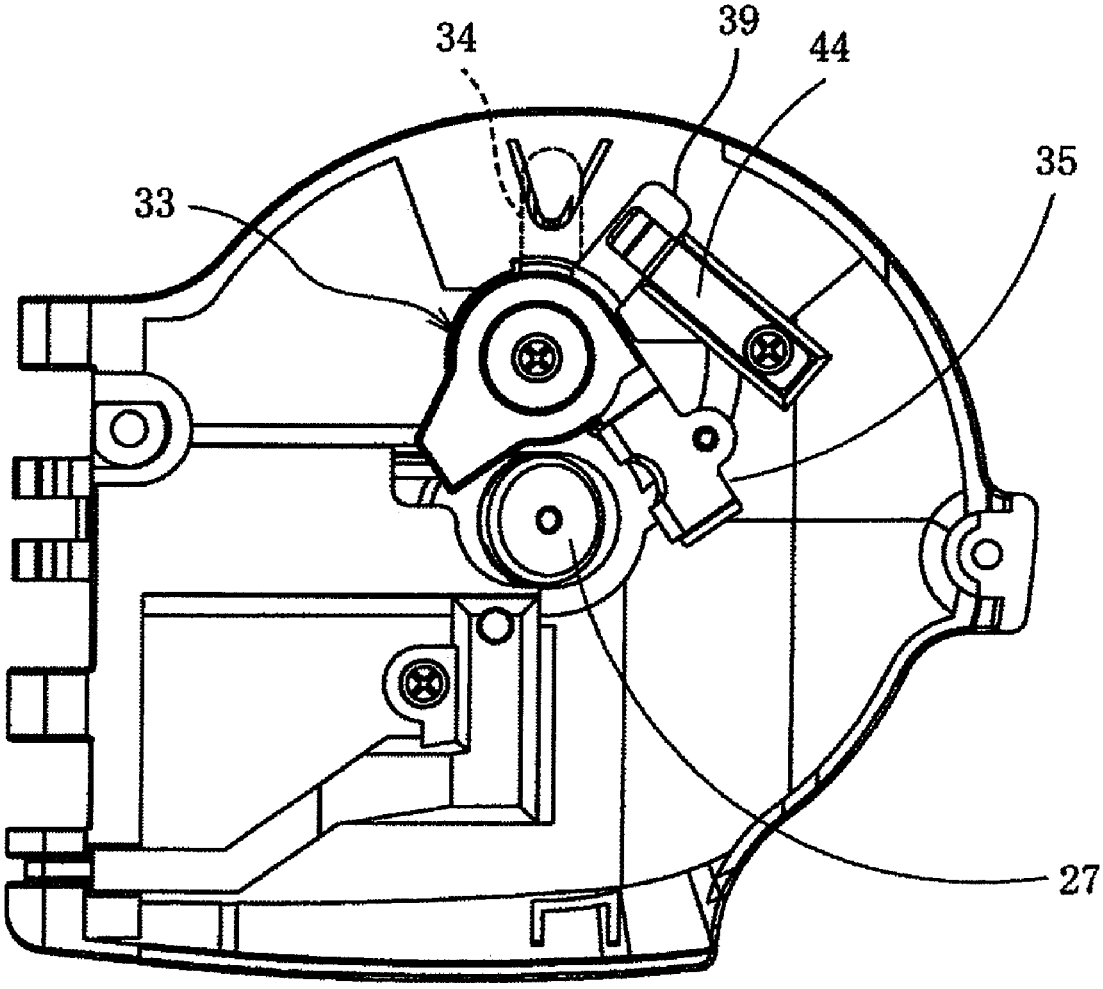
FIG. 9 is a side view of an inner surface of the inner side wall in the state where the support arm opens.

Further, on the outer side wall 14 in the bottom portion of the housing concave portion 43, a V-shaped engaging piece 47 is cut and formed at a position corresponding to the other turning end of the reel stopper 33 as shown in FIG. 5. At a tip end portion of the engaging piece, a projection 48 (see FIG. 2) is formed. Accordingly, when the reel stopper 33 is turned to the other turning end, as shown in FIG. 8 and FIG. 9, the concave portion 36 of the lever part 34 and the projection 48 resiliently engage with each other. At the turning end, a clicking feeling is obtained, so that an operator can know turning to the turning end.

Next, in the above-described configuration, when the wire reel 4 is attached, upon setting the support arm 26 in the state of FIG. 7 and FIG. 8, the wire reel 4 is put into the housing chamber 3. Then, as shown in FIG. 7, the annular concave portion 20 forming the shaft receiving portion of one flange 18 of the wire reel 4 and the reel guide 22 of the inner side wall 13 of the housing chamber 3 are fitted to each other. Accordingly, the wire reel 4 is positioned. After the wire reel 4 is set at the predetermined position, the support arm 26 provided on the outer side wall 14 is turned to approach the outer side wall 14 and the reel receiver 27 is pushed so as to project to the inside of the outer side wall 14 from the opening 24 as shown in FIG. 2 and FIG. 4(*a*) and FIG. 4(*b*). The reel receiver 27 is fitted in the central hole 21 forming the shaft receiving portion of the other flange 19.

Figure 10A:
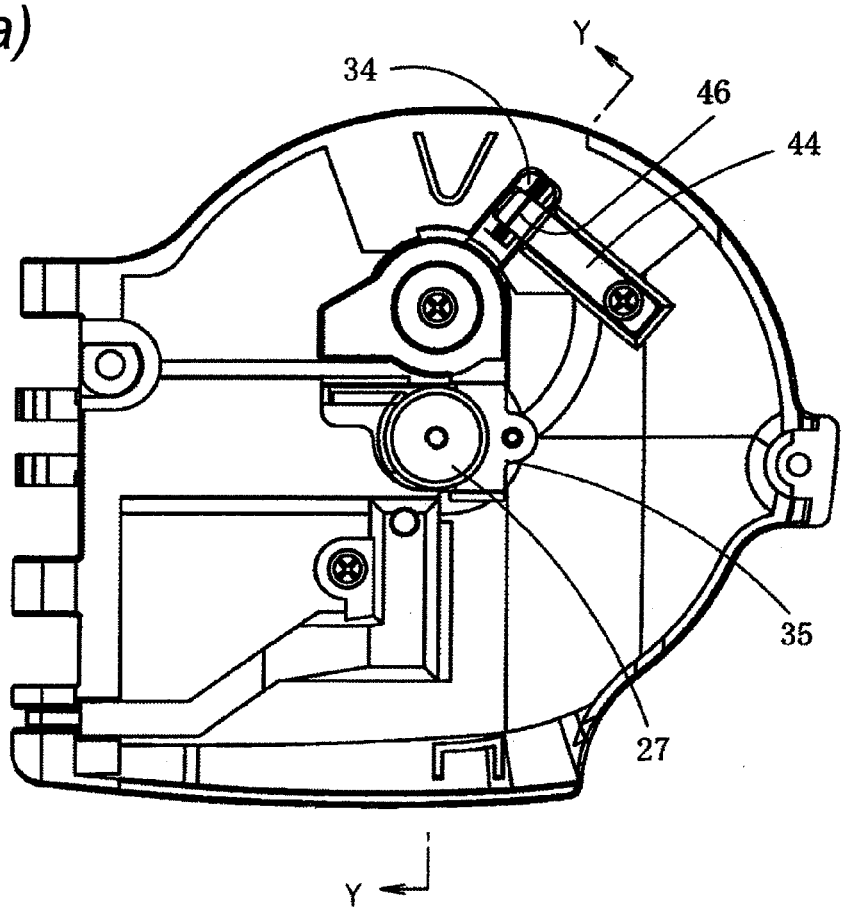
FIG. 10(*a*) is a side view of the inner surface of the inner side wall in a state where the support arm is closed for locking, and FIG. 10(*b*) is a sectional view along Y-Y line of FIG. 10(*a*).
Figure 10B:
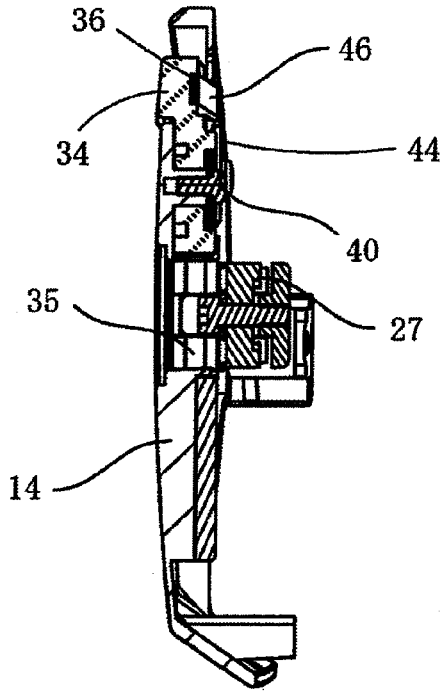

Further, as shown in FIG. 9 and FIG. 10(*a*) and FIG. 10(*b*), the lever part 34 of the reel stopper 33 is turned to the turning end. The convex portion 46 of the leaf spring 44 is engaged with the concave portion 36 of the lever part 34 resiliently, and as shown in FIG. 6, the stopper part 35 moves so as to overlap the back side of the engaging plate 31 of the reel receiver 27. Accordingly, the reel receiver 27 is locked by the stopper part 35 so as not to move to the outside, so that the wire reel 4 can be stably supported.

When the stopper part 35 is moved in a direction of locking the reel receiver 27, the C-shaped cover 37 of the stopper part 35 and the engaging plate 31 of the reel receiver 27 rub against each other. However, these are made of a metal such as iron, so that even if they are repeatedly engaged and disengaged, the engaging portion is hardly worn, and an excellent engaged state can always be secured.

Further, in the engaged state, the leaf spring 44 urges the lever part 34 of the reel stopper 33 so as to push it out, so that as shown in FIG. 10(*b*), the stopper part 35 positioned at the opposite side across the rotation shaft (screw 40) is urged inward, that is, urged to push the reel receiver 27 to the wire reel 4 side. Therefore, during rotation of the wire reel 4, the reel receiver 27 is prevented from moving inward and outward, and without axial shaking, the reel stopper 33 becomes stable and the wire reel 4 can always be stably rotated.

When the lever part 34 is turned, the convex portion 46 of the leaf spring 44 and the concave portion 36 of the lever part 34 engage with each other resiliently, and at the turning end of the lever part, a clicking feeling is obtained, so that an operator can know that the lever part is turned to the turning end and a locked state is obtained. The same applies to the case of returning to the standby position.

When the wire reel 4 is thus fitted into the housing chamber, the wire reel 4 is supported by the reel guide 22 of the inner side wall 13 and the reel receiver 27 of the outer side wall 14, and these serve as a rotation shaft of the wire reel 4 and the wire reel 4 can be stably rotated.

While description has been made in connection with specific exemplary embodiment of the invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A reinforcing bar binder comprising:

a housing chamber in which a wire reel is rotatably housed;

an opening formed through one of both side walls of the housing chamber at a position corresponding to a shaft receiving portion of the wire reel;

a reel receiver which is provided on said one of the side walls so as to come out from and come into the opening and fit to the shaft receiving portion of the wire reel when the reel receiver is pushed into an inside of said one of the side walls;

a reel stopper which is movable along a wall surface of said one of the side walls to engage with the reel receiver fitted to the shaft receiving portion;

an elastic body which urges the reel stopper engaged with the reel receiver in a direction so that the reel stopper is pushed-in toward the wire reel;

a concave portion provided on one of the elastic body and the reel stopper; and a convex portion provided on the other of the elastic body and the reel stopper and capable of resiliently engaging with the concave portion.

2. The reinforcing bar binder according to claim 1, further comprising:

a metallic cover provided on an engaging portion between the reel receiver and the reel stopper.

3. A reinforcing bar binder, comprising:

a housing chamber in which a wire reel is rotatably housed;

an opening formed through one of both side walls of the housing chamber at a position corresponding to a shaft receiving portion of the wire reel;

a reel receiver which is provided on said one of the side walls so as to come out from and come into the opening and fit to the shaft receiving portion of the wire reel when the reel receiver is pushed into an inside of said one of the side walls;

a reel stopper which is movable along a wall surface of said one of the side walls to engage with the reel receiver fitted to the shaft receiving portion; and an elastic body which urges the reel stopper engaged with the reel receiver in a direction so that the reel stopper is pushed-in toward the wire reel, wherein the reel stopper includes a lever part and a stopper part, wherein the stopper part moves to engage with and disengage from the reel receiver by operating the lever part, and wherein the elastic body is adapted to push the lever part so that the stopper part engaged with the reel receiver pushes the reel receiver toward the wire reel.

* * * * *